United States Patent [19]

Mills et al.

[11] Patent Number: 4,813,501

[45] Date of Patent: Mar. 21, 1989

[54] ROTARY MINING BIT

[75] Inventors: Charles D. Mills, Shawnee; Thillmon F. Crider, Meeker, both of Okla.

[73] Assignee: Mills Machine Company, Shawnee, Okla.

[21] Appl. No.: 127,762

[22] Filed: Dec. 2, 1987

[51] Int. Cl.[4] ..... F21B 9/12

[52] U.S. Cl. ..... 175/335; 175/354

[58] Field of Search ..... 175/292, 334, 335, 354, 175/376, 385, 413; 299/89, 92

[56] References Cited

U.S. PATENT DOCUMENTS

| | | | |
|---|---|---|---|
| 1,131,701 | 3/1915 | Hughes . | |
| 1,151,104 | 8/1915 | Humason . | |
| 2,030,722 | 2/1936 | Scott | 255/73 |
| 3,659,660 | 5/1972 | Conn | 175/53 |
| 3,720,273 | 3/1973 | McKenry et al. | 175/335 |
| 3,821,993 | 7/1974 | Kniff et al. | 175/292 |
| 3,960,223 | 6/1976 | Kleine | 175/385 |

FOREIGN PATENT DOCUMENTS

| | | | |
|---|---|---|---|
| 950930 | 7/1974 | Canada | 175/335 |

*Primary Examiner*—William P. Neuder

*Attorney, Agent, or Firm*—Laney, Dougherty, Hessin & Beavers

[57] ABSTRACT

A rotary bit which includes a bit body having a tapered, externally threaded neck located at one side of the bit body. The bit body includes three, flat, lateral side faces which extend at 120° to each other and thus lie in planes which would contain sides of an equilateral triangle. Groups of cutter supporting blocks are built-up on the bit body at circumferentially spaced intervals thereround and on the opposite side of the bit body from that from which the tapered neck extends. Each of the cutter supporting blocks defines a generally cylindrical bore for the purpose of slidably and rotatably receiving a cutter element in such bore. The several cutter elements thus mounted in the blocks are arrayed around a centrally located pilot cutter which is mounted on the bit body at a central location and in axial alignment with fluid passageways and ports which extend through the tapered neck and the bit body.

5 Claims, 5 Drawing Sheets

ROTARY MINING BIT

BACKGROUND OF THE INVENTION

1. Field of the Invention

This invention relates to earth boring bits adapted for carriage on the end of a drill string for drilling bore holes in the earth, and more particularly, to a rotary mining bit.

2. Brief Descripton of the Prior Arts

A number of mining bits have previously been proposed for use in mining minerals from the earth by rotating the bit while it is mounted at the end of an elongated drill string. A bit which is of this general type, and which has some similarity to the present invention, is described in McKenry et al U.S. Pat. No. 3,720,273 assigned to Kennametal, Inc. of Latrobe, Pa. This type of bit includes a bit body which can typically be a disc-shaped steel forging. On the upper or rear side of the solid bit body, a radially inwardly tapering neck or shank portion has its relatively larger end secured to the center of the body, and projects rearwardly therefrom.

This shank or neck portion carries external threads to facilitate connection of the bit to a tubular driving member, such as a drill string. A fluid passageway extends through the shank or neck portion and through the body and terminates in divergent ports so that fluid under pressure can be supplied to the working face of the bit to carry away from the working region, material chiseled from the bore hole by the bit.

On the opposite side of the body (the lower or forward side) from the externally threaded neck portion or shank, the body is provided with an internally threaded, axially extending bore which is axially aligned with the fluid passageway in the body. The bore receives the threaded neck portion of a pilot cutter.

The opposite side of the body from that from which the externally threaded tapered neck or shank extends may be termed the working face or cutting side of the body, and at circumferentially spaced locations thereabout, in line with the radially outer sides thereof, are a plurality of cutter support blocks. Typically there may be three or four of these cutter support blocks in a first, radially outermost group thereof, but there may be more. The cutter support blocks are mounted on the bit body so as to incline so that they lean in a circumferential direction with respect to the rotational axis of the bit, which direction of inclination is toward the direction of rotation of the bit.

Each of the cutter support blocks has a cutter element rotatably mounted therein. Each cutter element has a cylindrical shank which is disposed in a cylindrical bore formed in the respective cutter support block. The cutter elements are retained in their respective bores by means of resilient keeper rings, and can be easily removed and replaced when they become dulled. The several cutter support blocks are affixed to the bit body so that the cutters which are removably and rotatably carried in the several support blocks are inclined slightly outwardly in a radial direction, and also in the direction of rotation of the mining bit when it is in use. The cutter elements cooperate with the pilot cutter to accomplish efficient boring of a bore hole through an earthen formation.

BRIEF DESCRIPTION OF THE PRESENT INVENTION

The present invention provides an improved rotary bit which has an extended service life, is relatively easily repaired and reconstituted by replacement of certain parts subject to heavy wear, and is very efficient in "making hole" through rock and hard formations when used at the end of a drill string in a mining operation.

Broadly described, the bit of the invention includes a generally triangularly-shaped bit body which has three lateral faces or surfaces which extend in three planes oriented at angles of about 120° with respect to each other, and each extending substantially parallel to the axis of rotation of the bit. Stated differently, the lateral faces of the bit body are oriented so as to lie in planes containing the sides of an equilateral triangle. In addition to the described lateral faces, the bit body has a pair of axially opposed, transversely extending sides termed a lower or forward, cutting side and an upper or rear, connecting side. From the rear connecting side of the bit body, an externally threaded shank or neck portion projects in an axial direction, and facilitates the threaded engagement of the bit with an internally threaded box sub on the end of a drilling string. An axially extending passageway extends through the externally threaded neck or shank portion of the bit and into the bit body.

At the opposite side (the lower or forward side) of the bit body from the shank portion, the bit body has an axially facing beveled face or surface which includes three lobe sections lying between pairs of the lateral faces of the bit body. The axially facing beveled surface containing the lobe sections is a major portion of a conical figure having the axis of rotation of the bit as the central axis of the conical figure. The axially facing surface is beveled or inclined with respect to the axis of rotation of the bit at an angle of from about 25° to about 40°, and it extends from the radially outer portions of the bit body inwardly to a centrally located, generally cylindrical pilot cutter chuck base. The pilot cutter chuck base is positioned between the body and an axially extending, internally threaded pilot cutter chuck. A pilot cutter having an externally threaded shank is threaded into this pilot cutter chuck and projects axially away from the opposite side of the bit body from the side of the bit body upon which the tapered shank portion is located.

A plurality of divergent fluid discharge ports are formed through the pilot cutter supporting block for outwardly discharging drillig fluid passed through the passageway in the shank portion and the bit body. The drilling fluid is thus caused to flow against and around the cutter elements hereinafter described, and remove bit cuttings from the well bore.

At circumferentially spaced locations around the axially facing, beveled face on the lower or forward, cutting side of the bit body, a plurality of cutter supporting or mounting blocks making up a first group of such blocks, is mounted on the "first step" of the bit body. The cutter supporting blocks are mounted at substantially the same radial distance from the central rotational axis of the bit body, and these cutter supporting blocks are bored to receive, in a central hole or bore formed therein, a pick-type cutter element of the sort illustrated and described in U.S. Pat. No. 3,821,993 and in U.S. Pat.No. 3,720,273.

The cutter elements which are received in the central bores formed in the first group of cutter supporting or mounting blocks are referred to as a first group of cutter elements and also as gauge cutter elements. This first group of cutter elements is mounted so that the cutter elements lean or are inclined radially outwardly by an amount sufficient that their points lie on a circle spaced radially outwardly from the outermost portion of the bit body by an amount adequate to make the hole which is bored by the bit slightly larger than the bit body.

A second group of cutter supporting blocks and a second group of cutter elements rotatably supported therein are located radially inwardly from the first group of cutter elements. The cutter blocks and cutter elements in the second group are mounted on the axially forward face of the pilot cutter chuck base, and thus are upon a second axial step. These cutter elements in the second group and located on the second step may be on different radial spacings from the axis of rotation of the bit in relation to each other so as to scribe different circular lines of cutting of differing radii as they contact the formation to be drilled. Each cutter element in the second group is, however, radially outward from the axis of rotation and radially inwardly from the points or tips of the cutters in the first group.

An important object of the present invention is to provide a rotary bit which can bore through rock and hard soils faster than comparable bits.

Another object of the inventin is to provide a claw-type rotary bit having a long and trouble free service life.

GENERAL DESCRIPTON OF THE DRAWINGS

FIG. 6 is a longitudinal sectional view taken through a part of the bit body, and through the tapered neck formed on the body on one side thereof, and extending along line 6—6 of FIG. 2.

DETAILED DESCRIPTION OF A PREFERRED EMBODIMENT OF THE INVENTION

Figure 1:
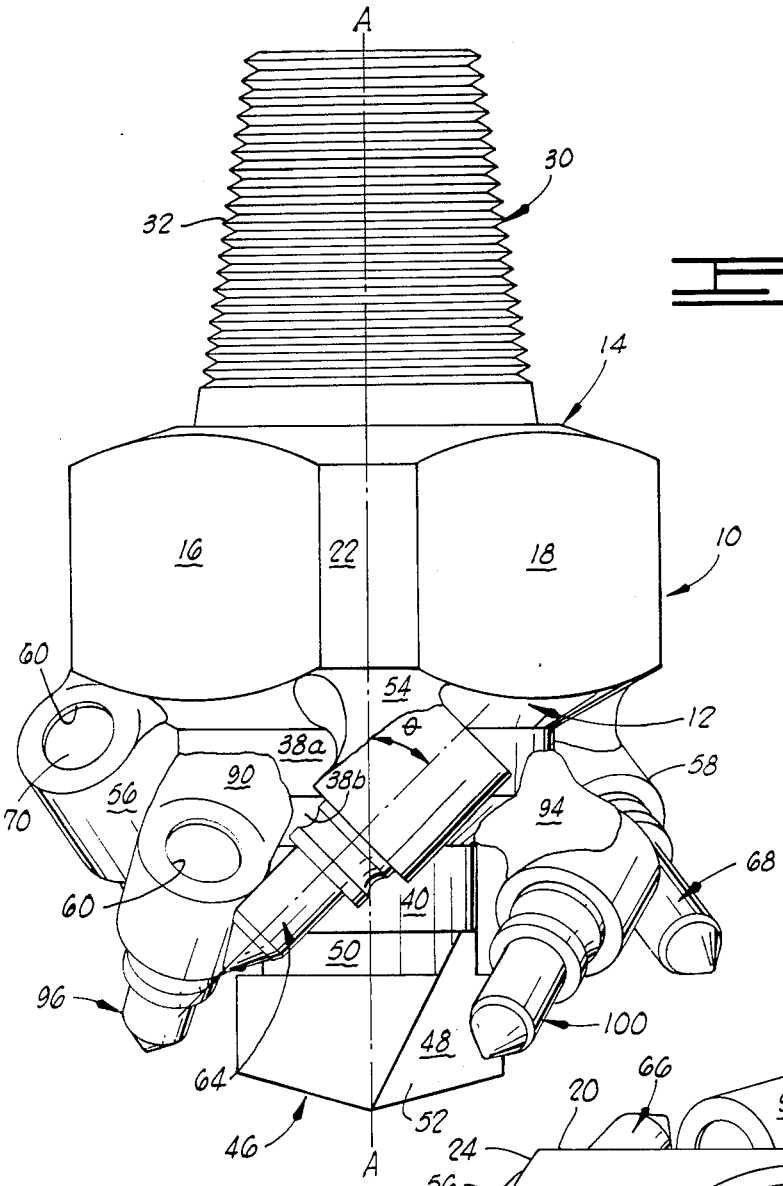
FIG. 1 is a side elevation view of a rotary bit constructed in accordance with the present invention.
Figure 2:
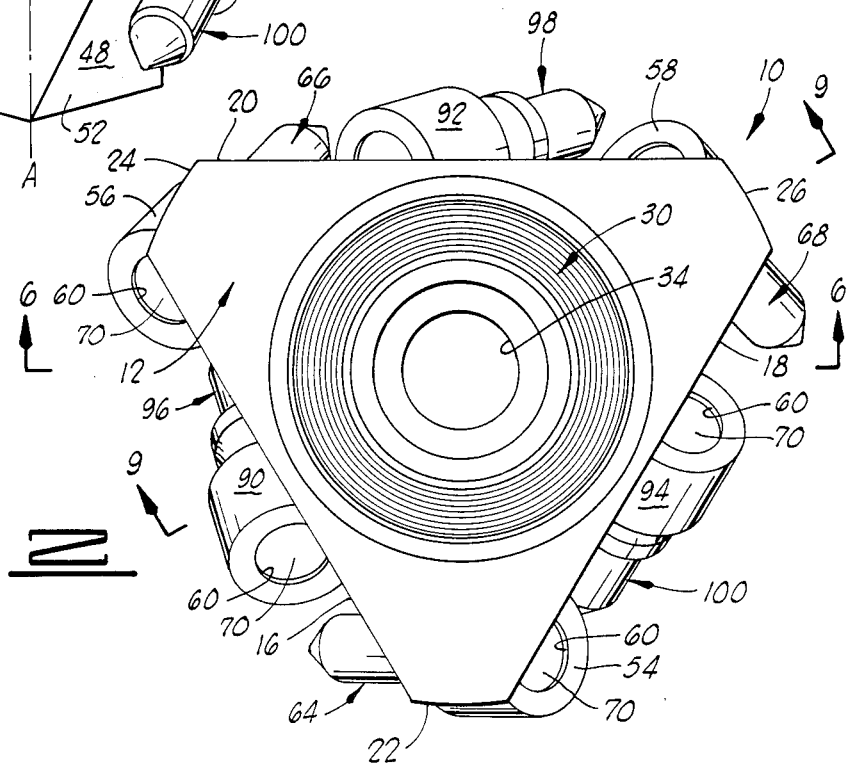
FIG. 2 is a top plan view of the bit depicted in FIG. 1.

Referring initially to FIG. 1 of the drawings, one embodiment of the bit of the invention is there illustrated in side elevation. The bit includes a body, designated generally by reference numeral 10. The body 10 is a generally disc-shaped member which has a lower or forward, cutting side 12, a rearward, connecting side 14 and a plurality of flat lateral faces or sides 16, 18 and 20. Each of the lateral faces 16, 18 and 20 lies in a plane which contains one of the sides of an equilateral triangle, and each of these planes extends parallel to an axis of symmetry and rotation A—A of the bit (see FIG. 1). Each of the lateral faces 16, 18 and 20 also lies between axially facing conically beveled or tapered fac es on the opposite sides of the bit body. The beveled faces are formed within conical figures of revolution on radii extending from centers of curvature located on the axis of rotation of the bit.

Each of the lateral faces 16, 18 and 20 is substantially identically shaped and, at its midpoint, is disposed a radial distance from the central rotational axis A—A of the bit which is equal to the radial distance at which each of the other two lateral faces of the bit is disposed from this rotational axis. Each adjacent pair of the lateral faces 16, 18 and 20 are separated by a small face of substantially rectangular configuration at the location where the corners of an equilateral triangle defined by the lateral faces 16, 18 and 20 are truncated. The small, rectangular, intermediate faces are denominated by reference numerals 22, 24 and 26. Disposed concentrically around the rotational axis of the bit and located in the center of the body 10 is an axially extending fluid-flow passageway 28, as shown in FIG. 6. The passageway 28 extends to the rearward, connecting side 14 of the bit body 10.

Secured to the upper or rearward, connecting side 14 of the body 10 at a central location thereon is an axially projecting tapered shank or neck portion, designated generally by reference numeral 30. The tapered neck portion 30 is externally threaded with a plurality of threads 32, and is thereby adapted to be threaded into a box-type sub of a drilling string (not shown) having a tapered, internally threaded female socket therein. The tapered neck portion 30 defines a central, generally cylindrical passageway 34 which extends therethrough from one end of the tapered neck portion to the other, and is axially aligned, and in registry with, the fluid passageway 28 in the body 10.

On the forward, cutting side 14 of the body 10, a built-up, axially extending pilot cutter assembly 36 projects axially from the body 10, and includes a pilot cutter chuck base 38 and an internally threaded pilot cutter chuck 40. The pilot cutter chuck base 38 has an axial thickness, measured along a radially outwardly facing annular peripheral side **38*a*, of about $\frac{3}{4}$ inch. It also has an axially facing second step surface 38*b*** which is conically shaped and slopes at an angle of 30° with respect to the axis of rotation of the bit.

Figure 3:
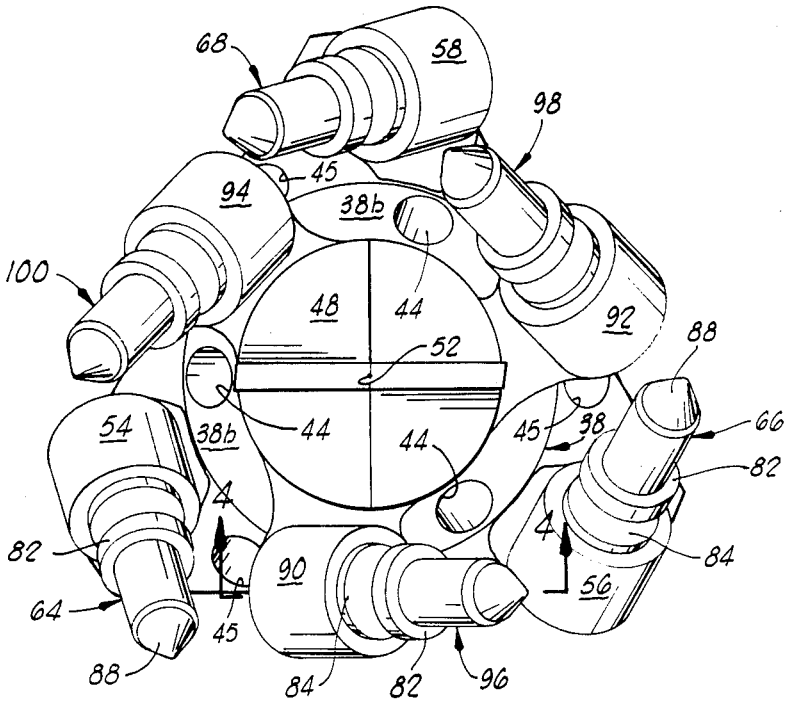
FIG. 3 is a bottom plan view of the bit depicted in FIG. 1.

The pilot cutter chuck 40 defines an internally threaded bore 42 which is axially aligned with, but physically segregated from, the fluid passageways 28 and 34. A plurality of divergent fluid ports 44 project off of the fluid passageway 28 at acute angles, and each of these ports opens at a forwardly facing opening in the forward side of the pilot cutter chuck base as shown in FIGS. 3 and 6. It will be noted that additional divergent fluid ports 45, which branch off of the fluid passageway 28, open at the axially facing beveled first step face on the forward, cutting side of the bit body 10 as also shown in FIGS. 3 and 6. Each of the ports 44 and 45 is angled so as to jet fluid directly to, and against, one of the cutting elements. The function of the ports 44 and 45, operating in a cooperating manner with the fluid passageways 28 and 34, will be hereinafter explained.

At the forward side of the rotary bit, a pilot cutter, designated generally by reference numeral 46, is threadedly secured in the pilot cutter chuck 40. The pilot cutter 46 may be formed in various shapes, but in the illustrated preferred form includes hard metal blade portions 48 which are fixed to a central steel support shaft 50. The pilot cutter 46 terminates in a point 52 at its forward end.

Figure 4:
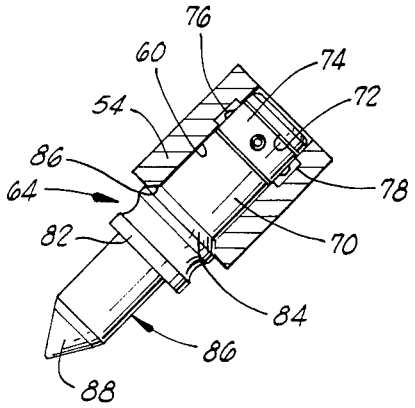
FIG. 4 is a detail view, partially in section and partially in elevation, of one of the cutter elements utilized in the present invention, and illustrating the manner in which this cutter element is rotatably mounted in a cutter mounting block forming a part of the invention.

At equally circumferentially spaced intervals around the outer side of the body 10 and upon the forward, cutting side 14 thereof, a plurality of cutter mounting blocks 54, 56 and 58 are welded to the beveled, first step face at the forward, cutting side of the body. The cutter mounting blocks 54, 56, and 58 are spaced radially from the central rotational axis of the bit and surround the pilot cutter 46 in a generally circular array. The cutter mounting blocks 54, 56 and 58 will be hereinafter referred to as the first group of blocks. Each of the blocks 54, 56 and 58 is centrally bored to provide a generally cylindrical, cutter shank-receiving bore 60 as shown in FIG. 4. Each of the cutter shank-receiving bores 60 in each of the respective cutter mounting blocks 54, 56 and 58 is angled in two different planes with respect to the rotational axis A—A of the bit, as will hereinafter be described, so that cutter elements which are rotatably mounted therein, as will be subsequently described, will project at such angles to the central rotational axis for a purpose and in a manner hereinafter described.

Figure 5:
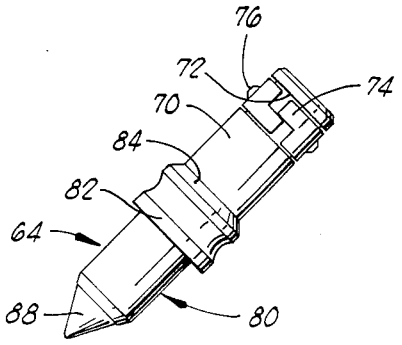
FIG. 5 is a side elevation view of one of the cutter elements.
Figure 5:
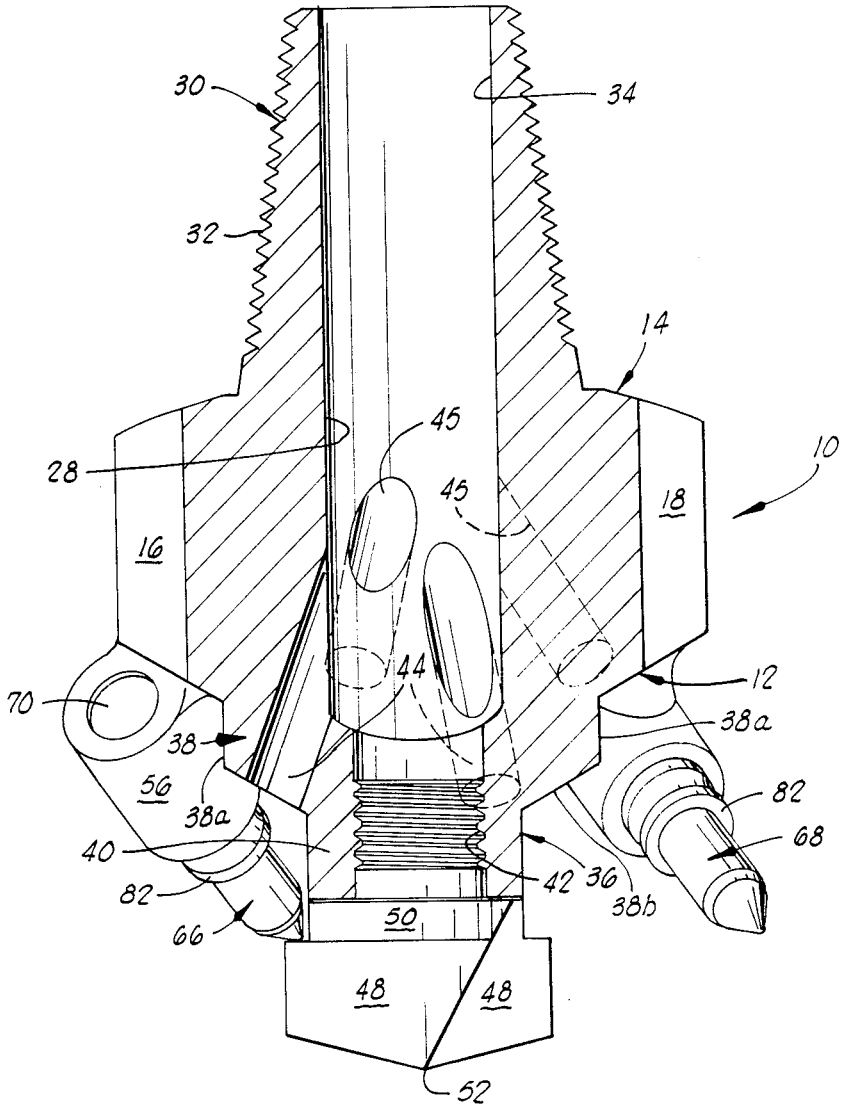

It should be pointed out that while three of the cutter mounting blocks 54, 56 and 58 have been described as making up the first group, and are the number illustrated in the accompanying drawings, there may be more of the cutter mounting blocks disposed in the first group of such blocks and located upon the first step face. Regardless of the number used, they will be disposed in a generally circular array, and at substantially equal circumferentially spaced intervals from each other in the manner which has been described and is illustrated in the drawings. It will be perceived in referring to FIGS. 1, 5 and 6 that the cutter mounting blocks 54, 56 and 58 are spaced axially rearwardly from the pilot cutter 46 by a substantial distance.

The first group of cutter mounting blocks 54, 56 and 58 rotatably supports on the bit body 10 at the location of the generally conical first step face, an equivalent number of pick-type cutter elements. The cutter elements in this first group of cutter elements, termed gauge cutter elements, are denominated by reference numerals 64, 66 and 68. Each of the gauge cutter elements 64, 66 and 68 includes a shank 70 which is of cylindrical configuration, and is sized to fit slidably and rotatably within the cylindrical bore 60 in the respective cutter mounting block 54, 56 and 58.

The shank 70 of each cutter element carries an annular groove or recess 72 into which is snapped a spring band 74 which has hemispherical bumps or protuberances 76 formed therearound. The bumps or protuberances 76 enter an annular groove 78 which is preferably of semi-circular, cross-sectional configuration formed, as shown in FIG. 4, around the side of the bore 60 in each of the cutter mounting blocks. Each of the cutter elements 64, 66 and 68 includes an external body portion 80 having a pair of reinforcing annular ribs 82 and 84 therearound. The rib 84 carries a tapered face which slidably engages a mating tapered seat 86 formed at the entrace of the bore 60 in the respective cutter block. Each of the cutter elements 64, 66 and 68 terminates in a pointed free end 88. It may here be noted that the description of the strucutral details of the gauge cutter elements 64, 66 and 68 applies with equal accuracy to the other cutter elements to which reference will be hereinafter made.

The gauge cutter elements 64, 66 and 68 are severally rotatably mounted in the respective cutter mounting block 54, 56 and 58 so as to lean radially outwardly with respect to the axis of rotation A—A of the bit. The tip of each of the gauge cutter elements 64, 66 and 68 is disposed on a circle which surrounds the axis of rotation of the bit so that the points or tips of the central cutter elements 64, 66 an d68 are spaced radially outwardly from the axis of rotation. In the embodiment of the invention shown in FIGS. 1–6, the several tips of the cutter elements 64, 66 and 68 lie on different concentric circles and are thus spaced on differing radial distance from the axis of rotation of the bit.

In addition to being slanted radially outwardly with respect to the axis of rotation (rather than extending parallel thereto), the gauge cutter elements 64, 66 and 68 also are inclined in the direction of rotation of the bit. Because of this, the loading of the several cutter elements tends to be along the axis of the cylindrical shank portions 70 of each cutter element, with the load directed straight down the shank of the cutter element and into the tip thereof.

Figure 7:
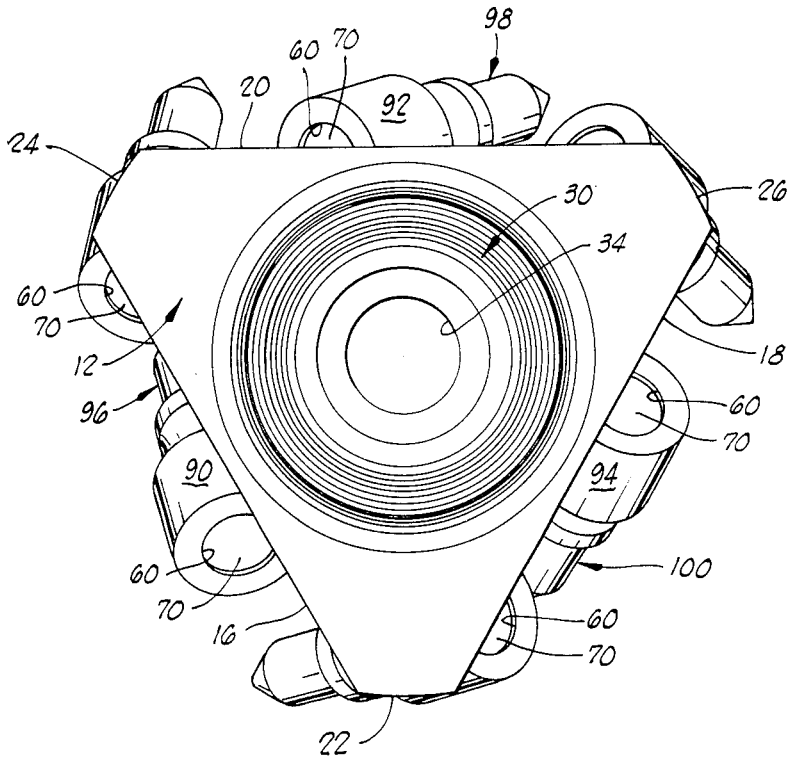
FIG. 7 is a top plan view of another, and preferred, embodiment of a rock claw bit constructed in accordance with the present invention.
Figure 8:
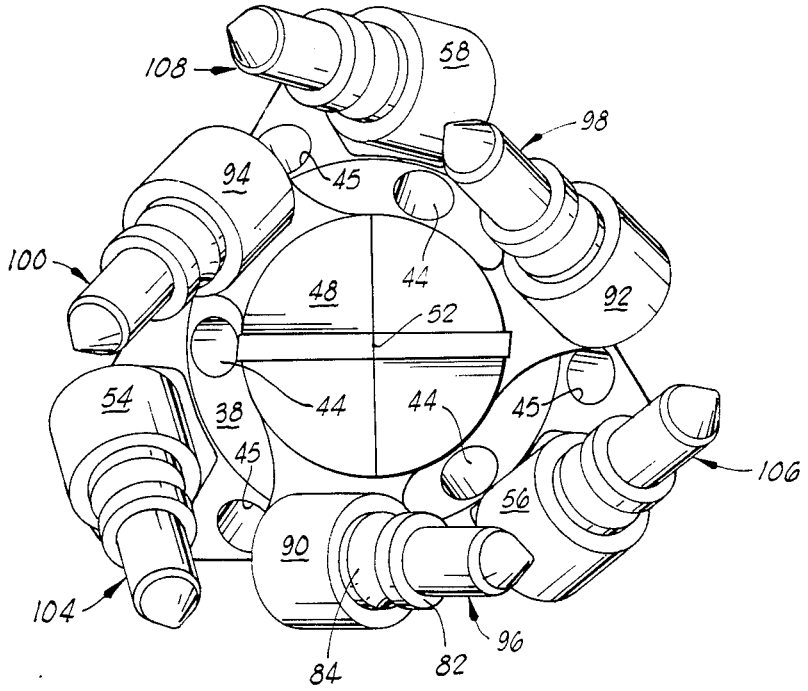
FIG. 8 is a bottom plan view of the preferred embodiment illustrated in FIG. 7.
Figure 9:
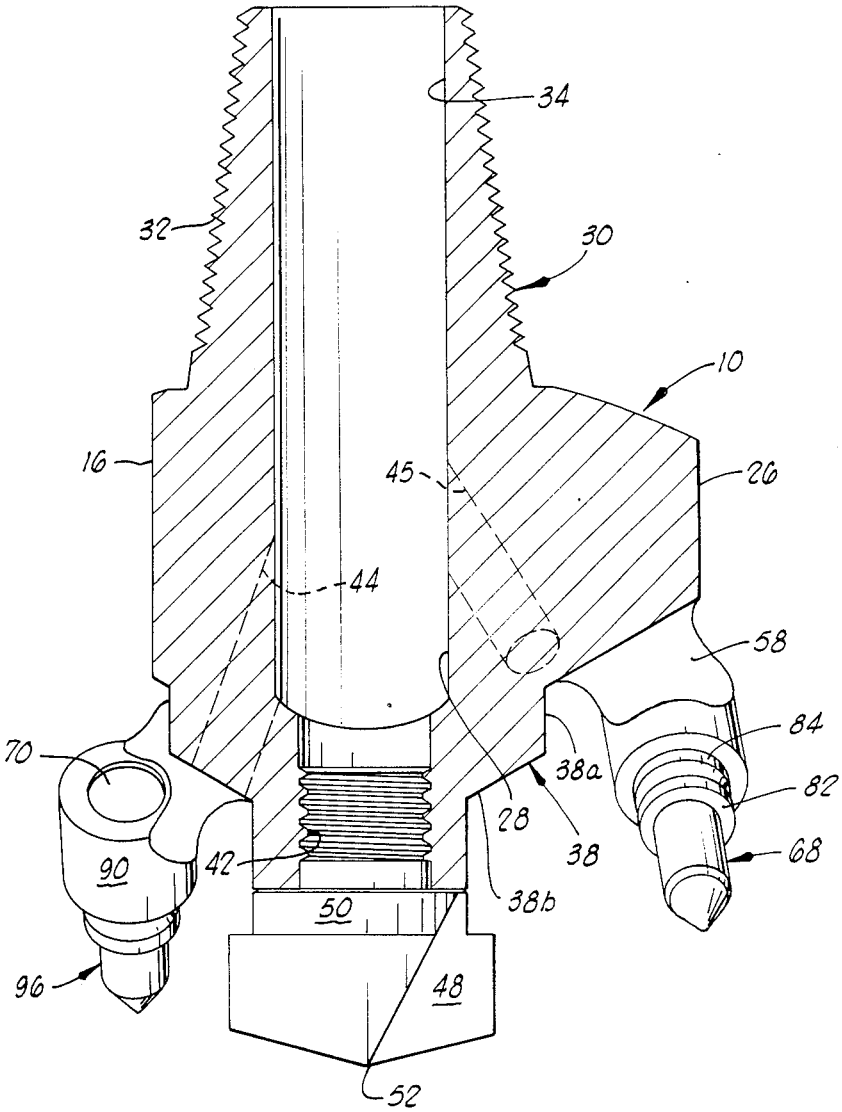
FIG. 9 is a sectional view taken along line 9—9 of FIG. 2.

In the preferred embodiment of the invention, as illustrated in FIGS. 7 and 8, the gauge cutter elements in the first group are denominated by reference numerals 104, 106 and 108. Each of the gauge cutter elements 104, 106 and 108, as provided in this preferred embodiment, leans outwardly in a radial direction as a result of its mounting in its respective mounting block 54, 56 or 58. In this embodiment, the cutter elements and their tips are equidistantly spaced from the axis of rotation of the bit, and thus lie on a common circle. The tip portions of the several gauge cutter elements 104, 106 and 108 lie about 3/16ths of an inch outside the circle which circumscribes or passes through the outermost portions of the bit body 10. These outermost portions are the small rectangular faces 22, 24 and 26 which lie within an imaginary cylinder which extends around the bit body in a location concentric to the axis of rotation A—A. FIGS. 7 and 8 illustrate the manner in which the gauge cutter elements 104, 106 and 108 lie outside of the imaginary circle (or cylinder) which defines the radially outer extremity of the bit body 10. Because of this differential between the radial position of the tips of the gauge cutter elements 104, 106 and 108 and the radial position of the faces 22, 24 and 26 carried on the outer side of the bit body 10, the gauge cutter elements function to define the diameter of the hole drilled by the bit, and afford easy clearance and passage of the bit body into this hole as the hole is projected into the earth.

The angle at which the several gauge cutter elements (64, 66 and 68 in the embodiment illustrated in FIGS. 1–6, and 104, 106 and 108 in the embodiment illustrated in FIGS. 7 and 8), are leaned in the direction of rotation of the bit is about 45°. This angle is that which is denominated by $\theta$ (theta) in FIG. 1 of the drawings.

In the illustrated embodiments of the invention, the bit includes a second group of cutter mounting blocks 90, 92 and 94, in addition to the cutter mounting blocks 54, 56 and 58 and the gauge cutter elements 64, 66 and 68 disposed in the first group (which are at the radially outermost locations on the bit body 10). The cutter mounting blocks 90, 92 and 94 in the second group are disposed radially inwardly with respect to the location of the cutter mounting blocks 54, 56 and 58, and are circumferentially offset and alternately staggered from the latter cutter blocks in the first group. This arrangement and the relative spacing are illustrated in FIGS. 3 and 8 of the drawings. The cutter mounting blocks 90, 92 and 94 are mounted upon the second step or tier constituted by the pilot cutter chuck base 38 so that the bores 60 for receiving cutter elements of a second group therein, as previously described, are located axially well forward of the cutters 64, 66 and 68 and the cutter mounting blocks 54, 56 and 58 of the first group. In this regard, it will be recalled that the axial thickness of the chuck base 38 at its outer peripheral side is about ¾ths inch. Stated differently, the cutter mounting blocks 90, 92 and 94 in the second group are mounted at an axially forward or advanced position wiht respect to the cutter mounting blocks in the first group, and are, in this respect, positioned substantially closer, in an axial sense, to the pilot cutter 46 than are the first group cutter mounting blocks 54, 56 and 58. They are also radially closer to both the pilot cutter 46 and to the axis of rotation A—A of the bit. The cutter mounting blocks 90, 92 and 94 in the second group mounted upon the step which is constituted by the pilot cutter chuck base 38 are disposed at slightly differing radial distances outwardly from the axis of rotation A—A of the bit. Because of this, and because of the fact that the conical, axially facing surface 38b of the base 38 slopes rearwardly from the axis of rotation radially outwardly (at an angle of about 30° off of a plane extending normal to the axis of rotation), the cutter elements carried in these cutter mounting blocks of the second group will be axially staggered, and their tips will be axially offset from each other by a slight amount.

Rotatably mounted within the bores 60 formed centrally in the cutter blocks 90, 92 and 94 of the second group are a second group of cutter elements 96, 98 and 100. These are clearly illustrated in FIGS. 2, 3, 7 and 8 of the drawings, and may be partially seen in FIGS. 1 and 6. The cutter elements 96, 98 and 100 in the second group have their points disposed at varying radial distances from the axis of rotation A—A of the bit so that they scribe circles of different diameters as they cut against the bottom of the bore hole. The cutter elements 96, 98 and 100 in the second group, as in the case of the cutters in the first group, are inclined at an angle of about 45° in the direction of rotation of the bit, so that loading on each cutter element during rotation of the bit is concentrated along the axis of the cutter element shank into the point of the respective cutter element.

The several points of the cutter elements 96, 98 and 100 of the second group are preferably located slightly off-line in a radially outward and axially forward direction froma line drawn between the tip 52 of the pilot cutter 46 and any of the tips on the several gauge cutter elements 64, 66 and 68 included in the first group thereof (or cutter elements 104, 106 and 108 in the preferred embodiment of FIGS. 7 and 8). The fact that the cutter elements 96, 98 and 100 are disposed at varying radial distances from the axis of rotation A—A of the bit, coupled with the fact that the surface 38a of the pilot cutter chuck base 38 upon which they are supported and mounted slopes or inclines axially rearwardly as such surface extends outwardly from the central axis of rotation, causes the tips of the several cutter elements to be axially offset from each other. The tips of the several cutter elements 96, 98 and 100 thus not only scribe or cut circles of different diameters, but these circles are also offset from each other in an axial direction along the axis of rotation of the bit, and the arrangement is such that the radially outermost cutter has its tip, which is also the radially outermost of the tips, located the fartherest rearwardly in an axial direction (toward the bit body 10) of any of the cutter element tips.

Figure 10:
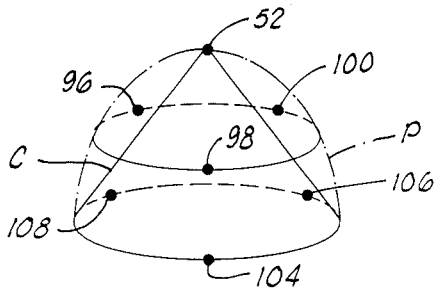
FIG. 10 is a diagrammatic illustration of the relative positions and geometric relationships of the several cutter element points.

Stated differently, the points at the free ends of the several cutter elements 96, 98 and 100 in the second group of cutter elements define a roughly parabolic curve when a geometric figure is plotted to intersect a figure of revolution which includes one or more of the points in the second group of cutter elements, and a figure of revolution which includes the tips of the cutter elements in the first group of cutter elements, and the tip 52 of the pilot cutter 46. This arrangement is diagrammatically portrayed in FIG. 10 of the drawings, where the parabolic curve described is illustrated and designated by reference letter P. The tip of the pilot cutter is designated by reference numeral 52, and the points on the several cutters are denominated by reference numerals 96, 98 and 100 (in the first group) and 104, 106 and 108 (in the second group of the preferred embodiment). This, of course, facilitates forming the bottom of the bore hole in a generally parabolic cross-sectional configuration, and enhances the efficiency and rate at which the bore hole can be projected into the formation. The amount by which each of the points of the cutter elements 96, 98 and 100 in the second group of cutter elements lies radially and axially outside of a conical figure (identified by C in FIG. 10) defined by the tip 52 of the pilot cutter 46, and points of the gauge cutter elements 104, 106 and 108 of the first group of cutter elements, is preferably from about ½ inch to about 1/16th inch.

OPERATION

In the operation and utilization of the rotary bit of the invention, the bit is mounted on the end of the drill string (not shown) by connection of the axially projecting tapered neck or shank 30. This shank 30 is threaded into an internally threaded box-type socket in a sub carried on the lower end of a drill string.

As the drill string is rotated, the lower, cutting side of the bit is forced toward the formation with the result that the several cutter elements engage the earth and remove cuttings therefrom to develop and project a bore hole into the earth. The gauge cutter elements 64, 66 and 68 (or 104, 106 and 108) function to determine, by the radially outer location of their tips, the diameter of the bore hole. As previously explained, in the bit of this invention, the tip of each gauge cutter element is preferably located from about 1/16th to about ½ inch, and most preferably about 3/16ths inch outside the greatest diameter of the bit body 10, which is that diameter extending through two of the small rectangular faces 20, 22 and 24. These faces, and indeed the entire bit body 10, clear the sides of the projected bore hole as the bit is rotated, because the gauge cutter elements in the first group have caused a sufficiently large diameter bore hole to be developed to facilitate such clearance.

The pilot cutter 46 functions, of course, to make a small pilot hole at the leading end of the bore hole, and to thus reduce the amount of power which is required to be spoiled to the bit in order to extend the bore hole at a relatively rapid rate into the formation in which it is being drilled. The second group of cutter elements 96, 98 and 100 mounted on the second group of cutter mounting blocks 90, 92 and 94 cuts the earth at locations which are on a generally parabolic curve between the points of the gauge cutter elements of the first group, and the tip of the pilot cutter (see FIG. 10). These cutter elements in the second group function to enlarge the bore hole at a location which is axially to the rear of the pilot cutter, but still axially in advance of the gauge cutter elements in the first group of cutter elements.

The inclination of the several cutter elements in both the gauge cutter elements of the first group, and the cutter elements 96, 98 and 100 of the second group, in relation to the direction of rotation of the bit assures that the loading on the several cutter elements is in an axial direction along the principal axis of rotation of each cutter element. Because of this, the propensity of the cutter element to wear, or to become bound up or frozen in the respective cutter mounting block in which it is rotatably received and supported is minimized. The ability of each cutter element to rotate about its axis as the cutting action is developed, and the bit is rotated, assures that the point or tip on each cutting element will wear evenly, as opposed to developing excessive wear along one side thereof resulting in early destruction of the cutter element.

Although a preferred embodiment of the invention has been herein described in order to illustrate the invention and the principles which cause the rotary bit to be highly efficient and an improvement over rock claw mining bits of the type heretofore in use, it will be appreciated that some changes and innovations in the structure and in the described geometric arrangement can be made without total sacrifice of all of the invention characteristics and features of the invention. Changes and innovations of this type are therefore deemed to be circumscribed by the spirit and scope of the invention, except as the same may be necessarily limited by the appended claims, or reasonable equivalents thereof.

What is claimed is:

1. A rotary bit comprising:

a body having three lateral faces defining an equilateral triangle, with each of said lateral faces spaced equidistantly from the axis of rotation of the bit, said body further having a forward, cutting side and a rearward, connecting side, said body defining an axially extending fluid passageway, and defining a plurality of spaced, angled ports each branching from said body passageway at an acute angle, and opening on the forward cutting side of the said body;

a neck projecting axially from a rearward, connecting side of said body and defining a neck passageway communicating with said fluid passageway in the body;

pilot cutter chuck means defining an axially extending bore on the opposite side of said body from, and aligned with, said body passageway, and opening in the cutting side of said body, said pilot cutter chuck means comprising:

a pilot cutter chuck base secured to the central portion of said body on the forward, cutting side thereof, and extending axially forwardly from said body and having an axially forward side, said pilot cutter chuck base including:

an annular, radially outwardly facing peripheral side projecting axially from the forward side of said body; and an axially facing, conically-shaped, second step surface having a central axis corresponding to the central axis of the bit and sloping at an angle of about 30° with respect to the axis of rotation of said bit, said second step surface intersecting said annular, radially outwardly facing peripheral side in a circular line extending concentrically around the rotational axis of the bit; and a pilot cutter chuck defining said bore and projecting axially forwardly from the center of the axially forward side of said cutter chuck base as constituted by said axially facing, conically-shaped, second step surface;

a pilot cutter movably secured in said bore and projecting in an axial direction from the center of said forward cutting side of said body;

a first group of spaced cutter mounting blocks secured to the forward, cutter side of said body in generally circular array therearound and around said pilot cutter chuck means, said cutter mounting blocks in said first group being spaced axially rearwardly in an axial direction from said pilot cutter in the direction of said neck, and disposed at the radially outer side of said bit body;

a first group of elongated cutter elements, said first group of cutter elements including a cutter element rotatably mounted on each of said cutter mounting blocks in said first group of cutter mounting blocks, and having a point on one end of the respective cutter element, each of said cutter elements in said first group of cutter elements being mounted for rotation about an axis extending radially outwardly at an acute angle to the rotational axis of the bit and the axes of said body, neck and the aligned passageways therethrough, and each of said rotational axes of the first group of cutter elements being inclined in the direction of rotation of the bit so that the point of the respective group cutter element is in the lead during the rotation of the bit, each of said first group cutter elements being spaced axially rearwardly from said pilot cutter;

a second group of spaced cutter mounting blocks mounted on said axially facing, conically-shaped, second step surface and on said annular radially outwardly facing peripheral side, said second group of spaced cutter mounting blocks being mounted in generally circular array around said pilot cutter and spaced around the axis of rotation of said bit, said cutter mounting blocks in said second group being positioned at an axial location which is axially rearward from said pilot cutter and axially forward from said cutter mounting blocks in said first group of cutter mounting blocks, said cutter mounting blocks in said second group being disposed radially inwardly from the cutter mounting blocks in said first group; and a second group of elongated cutter elements, said second group including a cutter element rotatably mounted on each of said cutter mounting blocks in said second group of cutter mounting blocks and having a point on one end of each of said cutter elements in said second group, each of the cutter elements in said second group of cutter elements being mounted for rotation about an axis extending radially outwardly at an acute angle to the axis of said body, neck and the aligned passageways therethrough, and with respect to the rotational axis of said bit, and each of said axes of rotation of the cutter elements in said second group being inclined in the direction of rotation of the bit so that the point on each of said cutter elements in the second group is in the lead during the rotation of the bit, said cutter elements in said second group of cutter elements being spaced axially rearward from said pilot cutter, and axially forward of the cutter elements in said first group of cutter elements, said second group of cutter elements each being positioned at a different radial distance from the rotational axis of the bit than is each of the other cutter elements in said second group, whereby the points of said second group cutter elements are rotated in circles having differing diameters, said second group of cutter elements having the points thereof lying outside of a conical figure which includes the point of said pilot cutter and the points of the cutter elements in said first group fo cutting elements.

2. A rotary bit as defined in claim 1 wherein said pilot cutter chuck means comprises:

a pilot cutter chuck base secured to the central portion of said body on the forward, cutting side thereof and extending axially forwardly from said body and having an axially forward side; and a pilot cutter chuck projecting axially forwardly from the center of the axially forward side of said cutter chuck base, and defining said bore,

3. A rotary bit as defined in claim 2 wherein said second group of cutter mounting blocks are secured to the forward side of said pilot cutter chuck base.

4. A rotary bit as defined in claim 1 and further characterized as including additional ports branching from said body passageway and opening at the axially forward side of said pilot cutter chuck base.

5. A rotary bit as defined in claim 1 wherein each of said cutter elements in said first group of cutter elements is inclined with respect to the vertical, and in the direction of rotation of said bit, at an angle of 45°.

* * * * *

UNITED STATES PATENT AND TRADEMARK OFFICE

CERTIFICATE OF CORRECTION

PATENT NO. : 4,813,501

DATED : March 21, 1989

INVENTOR(S) : Charles D. Mills and Thillmon F. Crider

It is certified that error appears in the above-identified patent and that said Letters Patent is hereby corrected as shown below:

In the Specification:

In Column 1, line 11, delete the word "Arts" and insert -Art-.

In Column 2, line 52, delete the word "drillig" and insert -drilling-.

In Column 2, line 55, delete the word "remove" and insert -removes-.

In Column 2, line 63, delete the word "distance" and insert -distances-.

In Column 3, line 29, delete "inventin" and insert -invention-.

In Column 4, line 8, delete "fac es" and insert -faces-.

In Column 6, line 12, delete "an d" and insert -and-.

In Colum 7, line 54, delete "froma" and insert -from a-.

In Column 8, line 65, delete "spoiled" and insert -applied-.

In the Claims:

In Column 9, line 52, delete "a" and insert -the-.

(2nd occurrence)

Signed and Sealed this

Seventeenth Day of October, 1989

*Attest:*

DONALD J. QUIGG

*Attesting Officer*

*Commissioner of Patents and Trademarks*